US011891748B2

(12) United States Patent
Matsumoto

(10) Patent No.: US 11,891,748 B2
(45) Date of Patent: Feb. 6, 2024

(54) CLOTHING DRYING DEVICE

(71) Applicant: KAWAJUN CO., LTD., Tokyo (JP)

(72) Inventor: Ikuya Matsumoto, Tokyo (JP)

(73) Assignee: KAWAJUN CO., LTD., Tokyo (JP)

( * ) Notice: Subject to any disclaimer, the term of this patent is extended or adjusted under 35 U.S.C. 154(b) by 430 days.

(21) Appl. No.: 17/292,767

(22) PCT Filed: Sep. 28, 2020

(86) PCT No.: PCT/JP2020/036578
§ 371 (c)(1),
(2) Date: May 11, 2021

(87) PCT Pub. No.: WO2021/070654
PCT Pub. Date: Apr. 15, 2021

(65) Prior Publication Data

US 2021/0395937 A1 Dec. 23, 2021

(30) Foreign Application Priority Data

Oct. 7, 2019 (JP) ..... 2019-184536

(51) Int. Cl.
*D06F 53/04* (2006.01)
*B65H 75/30* (2006.01)
*B65H 75/44* (2006.01)

(52) U.S. Cl.
CPC ..... *D06F 53/045* (2013.01); *B65H 75/30* (2013.01); *B65H 75/4431* (2013.01); *B65H 75/4434* (2013.01)

(58) Field of Classification Search
CPC ..... B65H 75/30; B65H 75/4431; B65H 75/4434; B65H 75/28; B65H 75/40; B65H 75/48; D06F 53/045; D06F 53/00

(Continued)

(56) References Cited

U.S. PATENT DOCUMENTS 1,017,010 A * 2/1912 McNair et al. .... B65H 75/4431 242/379.2
2,249,114 A * 7/1941 Coffman ..... D06F 53/045 242/381.1

(Continued)

FOREIGN PATENT DOCUMENTS

JP 2000-161767 A 6/2000
JP 2000-218091 A 8/2000

(Continued)

OTHER PUBLICATIONS

International Search Report w/English translation dated Dec. 1, 2020, issued in counterpart International Application No. PCT/JP2020/036578 (5 pages).

(Continued)

*Primary Examiner* — William A. Rivera
(74) *Attorney, Agent, or Firm* — WHDA, LLP

(57) ABSTRACT

Clothing drying device has: a drum with a rope wound around; a casing body having an entrance/exit surface and storing the drum, the entrance/exit surface being provided adjacent to a wall surface to which the casing body is fixed, the entrance/exit surface allowing the rope to go in and out; and a gate-shaped guide member provided on the entrance/exit surface, comprising a hole portion provided inside the guide member and the rope is passed through, a pair of pole portions extending in the direction intersecting with the wall surface and having an arc surface becoming convex toward the hole portion, and a beam portion passed between the pair of pole portions at the end portion opposite to the end portion of the wall surface side of the pair of pole portions and having an arc surface becoming convex toward the hole portion.

9 Claims, 8 Drawing Sheets

(58) Field of Classification Search
USPC ..... 242/378, 378.1, 378.2, 615.3, 615.4
See application file for complete search history.

(56) References Cited

U.S. PATENT DOCUMENTS 2,569,020 A * 9/1951 Rotherham ..... B65H 75/4431 242/380
3,021,091 A * 2/1962 Daisy ..... D06F 53/045 242/384.7
3,602,454 A * 8/1971 Leifheit ..... D06F 53/045 242/378
3,657,491 A * 4/1972 Ryder ..... H02G 11/02 242/378
4,470,558 A * 9/1984 Stamper ..... D06F 53/045 242/378
4,684,076 A * 8/1987 Stamper ..... D06F 53/045 242/379.2
4,846,090 A * 7/1989 Palmquist ..... B63B 21/16 242/379.2
5,027,958 A * 7/1991 Agardi ..... B65H 75/4471 211/119.16
7,100,861 B2 * 9/2006 Glasson ..... G01B 21/02 242/615
2010/0072314 A1 * 3/2010 Sherman ..... D06F 53/045 24/716

FOREIGN PATENT DOCUMENTS

JP 2008-52556 A 3/2008
JP 4741450 B2 8/2011
JP 2012-205622 A 10/2012
KR 10-2011-0001295 A 1/2011

OTHER PUBLICATIONS

Written Opinion dated Dec. 1, 2020, issued in counterpart International Application No. PCT/JP2020/036578 (4 pages).

* cited by examiner

CLOTHING DRYING DEVICE

TECHNICAL FIELD

The present invention relates to a clothing drying device capable of hanging laundry, etc. indoors.

BACKGROUND ART

An indoor clothing drying tool capable of pulling out a rope for hooking laundry is disclosed. This indoor clothing drying tool hangs a rope between opposing walls in a room, and laundry can be hung on this rope. The indoor clothing drying tool includes a drum with a rope wound around, a cover case surrounding the drum, a rope outlet provided on the front surface of the cover case, and a pulley provided between the rope outlet and the drum.

CITATION LIST

Patent Literature

[Patent Literature 1] Japanese Patent No. 4741450

DISCLOSURE OF INVENTION

Technical Problem

In order to provide the rope outlet on the front surface of the cover case, it is necessary to provide a large pulley between the drum and the rope outlet. However, when such a large pulley is provided, there is a problem that the thickness dimension or the height dimension of the cover case are increased by the size of the pulley.

Therefore, an object of the present invention is to provide a compact clothing drying device.

Solution to Problem

The above object is solved by the following present invention. That is, a clothing drying device of the present invention (1) has:

a drum with a rope wound around;

a casing body has an entrance/exit surface and storing the drum, the entrance/exit surface being provided adjacent to a wall surface to which the casing body is fixed, the entrance/exit surface allowing the rope to go in and out; and a gate-shaped guide member provided on the entrance/exit surface, comprising a hole portion provided inside the guide member and the rope is passed through, a pair of pole portions extending in the direction intersecting with the wall surface and having an arc surface becoming convex toward the hole portion, and a beam portion passed between the pair of pole portions at the end portion opposite to the end portion of the wall surface side of the pair of pole portions and having an arc surface becoming convex toward the hole portion.

Further, a clothing drying device of the present invention (2) is the clothing drying device according to (1), wherein the beam portion has an arch shape being convex in the direction away from the wall surface.

Further, a clothing drying device of the present invention (3) is the clothing drying device according to (1) or (2), comprising a spacer portion interposed between the guide member and the wall surface and defining a part around the hole portion to secure a space between the hole portion and the wall surface.

Further, a clothing drying device of the present invention (4) is the clothing drying device according to (1) to (3), comprising a receiving portion fixed to a wall surface different from the wall surface, wherein the rope has a grip portion provided on the end portion opposite to the drum and capable of being hooked on the receiving portion.

Further, a clothing drying device of the present invention (5) has:

a drum with a rope wound around;

a first frame having a plurality of fixing portions, the plurality of fixing portions are arranged along the pulling direction of the rope and used for fixing the device to the wall surface;

a second frame provided on both sides sandwiching the first frame and capable of engaging with the first frame; and a third frame fixed to the second frame so as to store the drum between the third frame and the second frame and having a supporting shaft rotatably supporting the drum.

Further, a clothing drying device of the present invention (6) is the clothing drying device according to (5), wherein the first frame has a first engaging portion protruding toward the second frame, and the second frame has a storage portion capable of storing the first frame, and a second engaging portion which is provided in the storage portion and capable of engaging with the first engaging portion, the second engaging portion being capable of engaging and disengaging with the first engaging portion moving relative to the direction along the wall surface and incapable of engaging and disengaging with the first engaging portion moving relative to the direction intersecting with the wall surface.

Further, a clothing drying device of the present invention (7) is the clothing drying device according to (6), wherein the first frame has a first part capable of being stored in the storage portion, and a second part extending from the first part in the direction intersecting with the first part and coming into contact with the second frame at the position the first engaging portion and the second engaging portion are engaged.

Further, a clothing drying device of the present invention (8) is the clothing drying device according to (7), wherein the second part has a second fixing portion fixing the second frame and the second part.

Further, a clothing drying device of the present invention (9) is the clothing drying device according to (8), wherein the drum incorporates a brake portion acting as a resistance when the drum rotates, and the second frame has a connecting portion connecting parts sandwiching the storage portion, and fixing the brake portion to prevent the brake portion from rotating together with the rotating drum.

Further, a clothing drying device of the present invention (10) is the clothing drying device according to (9), wherein the connecting portion defines a bottom portion of the storage portion.

Further, a clothing drying device of the present invention (11) is the clothing drying device according to any one of (5) to (10), wherein the drum has a ratchet-shaped gear portion, and a stopper portion engaging with the gear portion, and a disengaging portion disengaging the stopper portion from the gear portion are attached to either the second frame or the third frame.

Further, a clothing drying device of the present invention (12) is the clothing drying device according to (11), wherein the drum has a concave portion provided inside the gear portion and capable of incorporating a spring generating torque in the direction the rope is wound around the drum.

Effects of the Invention

According to the present invention, a compact clothing drying device can be provided.

DESCRIPTION OF EMBODIMENTS

Hereinafter, an embodiment of the clothing drying device of the present invention is described with reference to FIG. 1 to FIG. 10. The clothing drying device of the present invention can be used by pulling out a rope from the inside and is used by being fixed to a wall surface of a room in a house. Further, the clothing drying device can stretch this rope between the clothing drying device and a receiving portion fixed to another wall surface different from the wall surface. Laundry or the like can be hooked on the rope and dried indoors.

Figure 9:
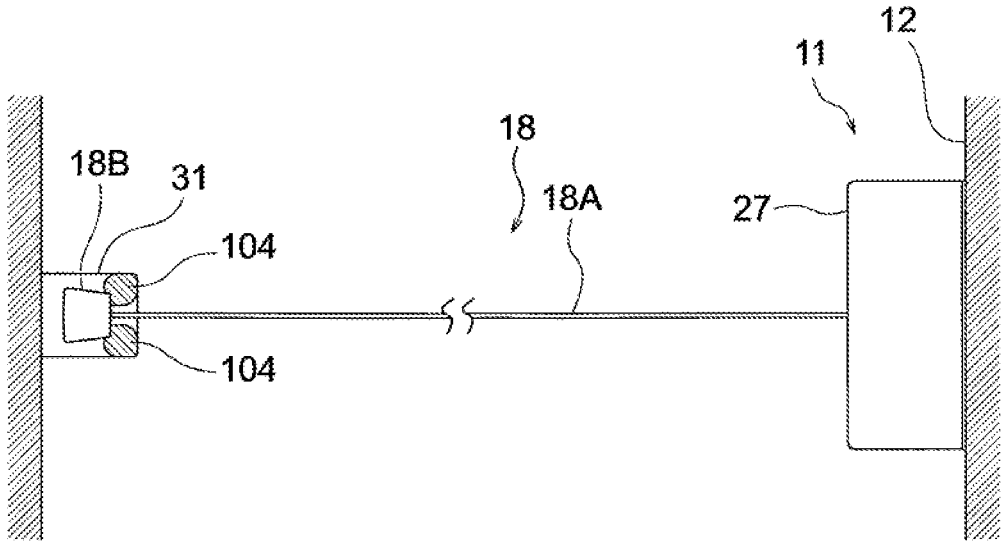
FIG. 9 is a top view showing an example of the positional relationship between the casing body of the clothing drying device shown in FIG. 1 and a receiving portion.

As shown in FIG. 1 to FIG. 5, a clothing drying device 11 includes: a first frame 13 fixed to a wall surface 12; a packing 14 interposed between the wall surface 12 and the first frame 13; a second frame 15 provided on both sides sandwiching the first frame 13; a third frame 17 fixed to the second frame 15 so as to store a drum 16 between the third frame 17 and the second frame 15; a rope 18; the drum 16 positioned between the second frame 15 and the third frame 17 and wound around with the rope 18; a spiral spring 21 (a power spring) arranged inside the drum 16; a brake portion 22 incorporated in the drum 16 at the position opposite to the side on which the spiral spring 21 is arranged; a guide member 23 provided between the second frame 15 and the third frame 17; a stopper portion 24 capable of engaging with a gear portion 64 of the drum 16; a disengaging portion 25 disengaging the stopper portion 24 from the drum 16; a small pulley 26 provided adjacent to the drum 16; a casing body 27 storing each of these structures; and a receiving portion 31 provided independently of the casing body 27 and fixed to a second wall surface 28 different from the wall surface 12 (see FIG. 9).

The casing body 27 is formed in a box shape. The casing body 27 has a front surface 32 facing the wall surface 12 in a room to which the clothing drying device 11 is fixed, and four side surfaces 33 adjacent to the front surface 32 and the wall surface 12. One of the four side surfaces 33 constitutes an entrance/exit surface 34 allowing the rope 18 to go in and out. The entrance/exit surface 34 has an opening portion 35, and a part of the guide member 23 (a base portion 87) and a second part 37 of the first frame 13 are fitted into the opening portion 35. The casing body 27 is preferably formed of a resin material or a metal material, and more preferably formed of, for example, stainless steel.

The rope 18 has a rope main body 18A, and a grip portion 13B provided at the end portion of the rope main body 18A far from the drum 16. The diameter of the rope main body 18A is preferably 0.3 to 3.0 mm, for example.

Figure 1:
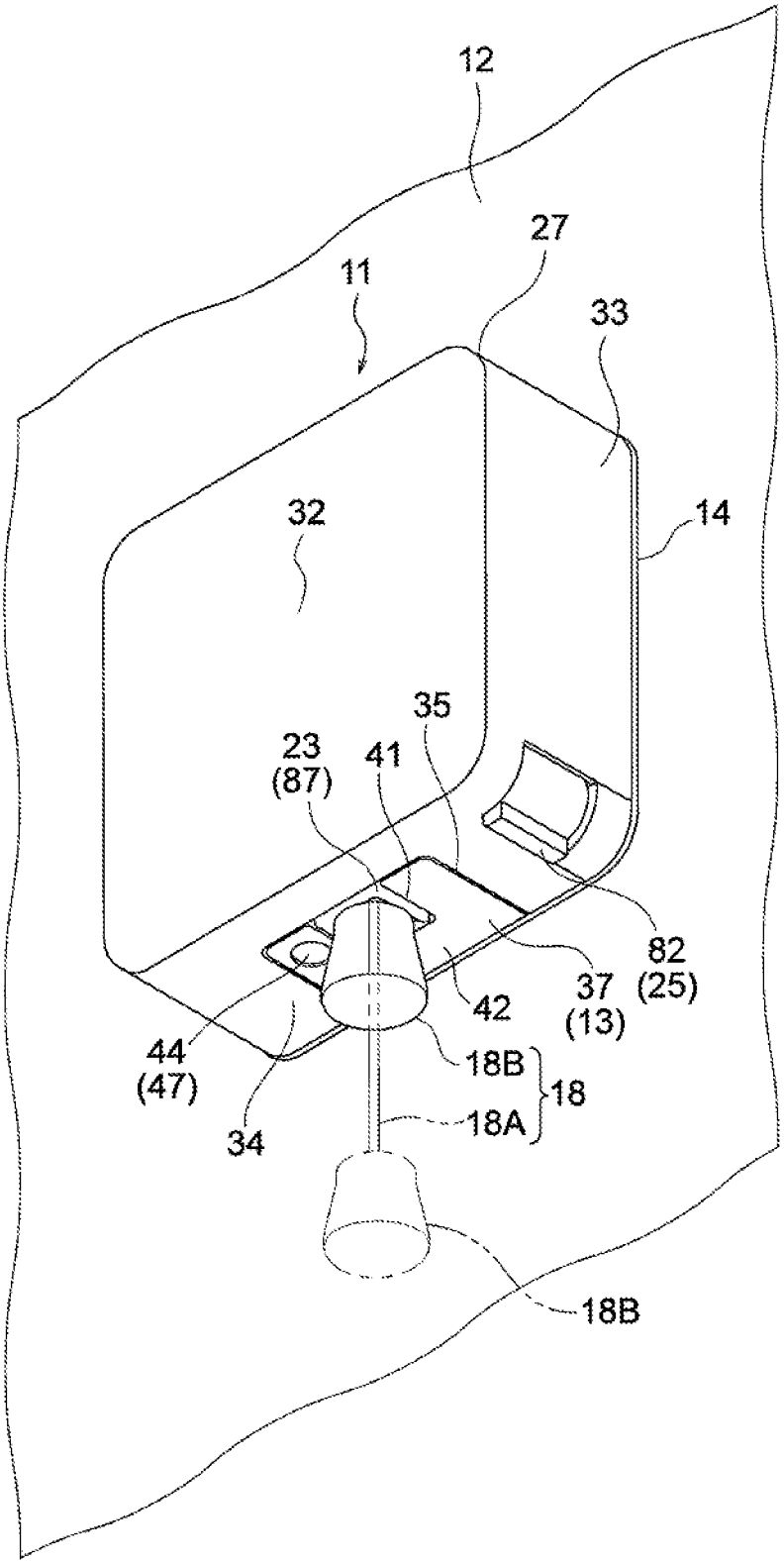
FIG. 1 is a perspective view of a clothing drying device of an embodiment as seen from the front.
Figure 2:
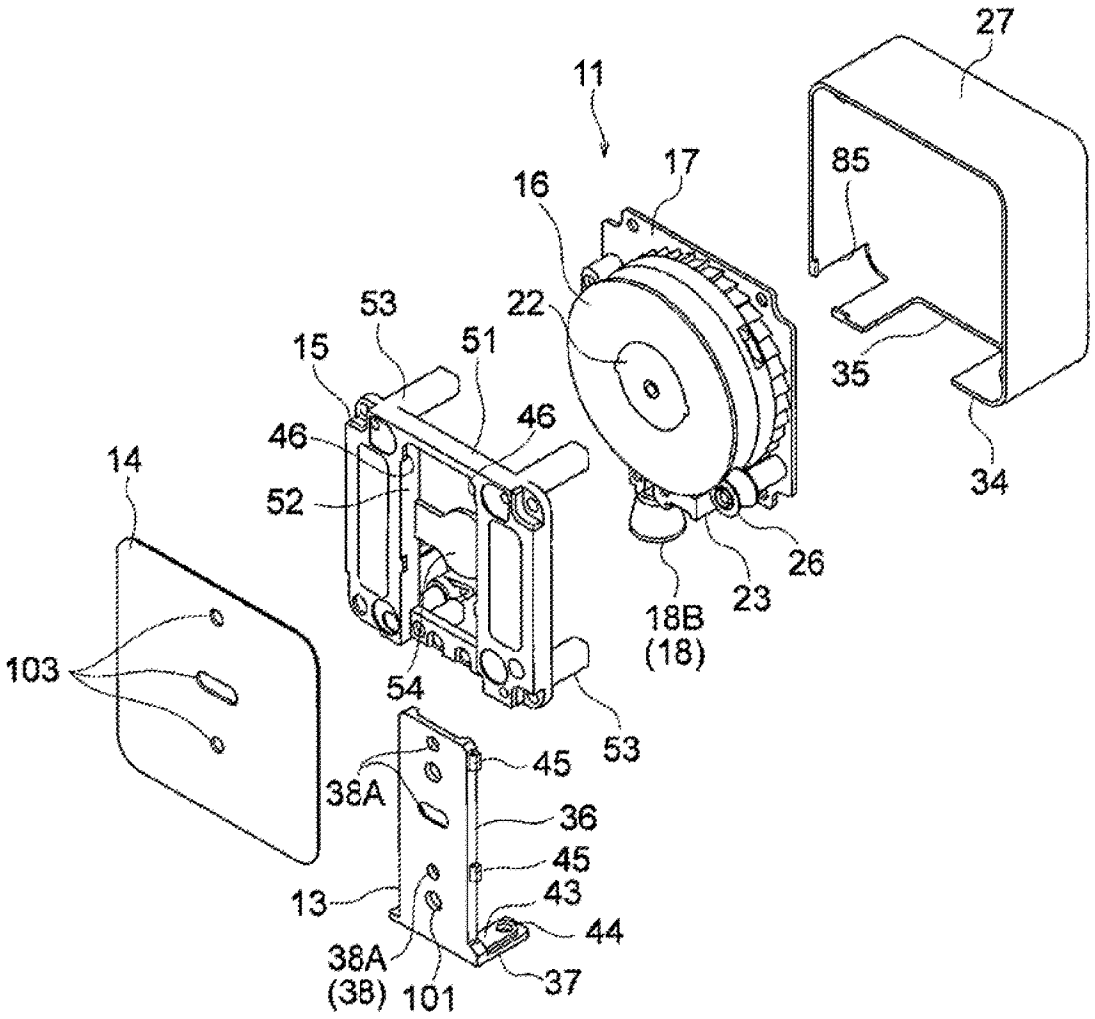
FIG. 2 is a perspective view of the clothing drying device shown in FIG. 1 partially disassembled as seen from the rear.
Figure 3:
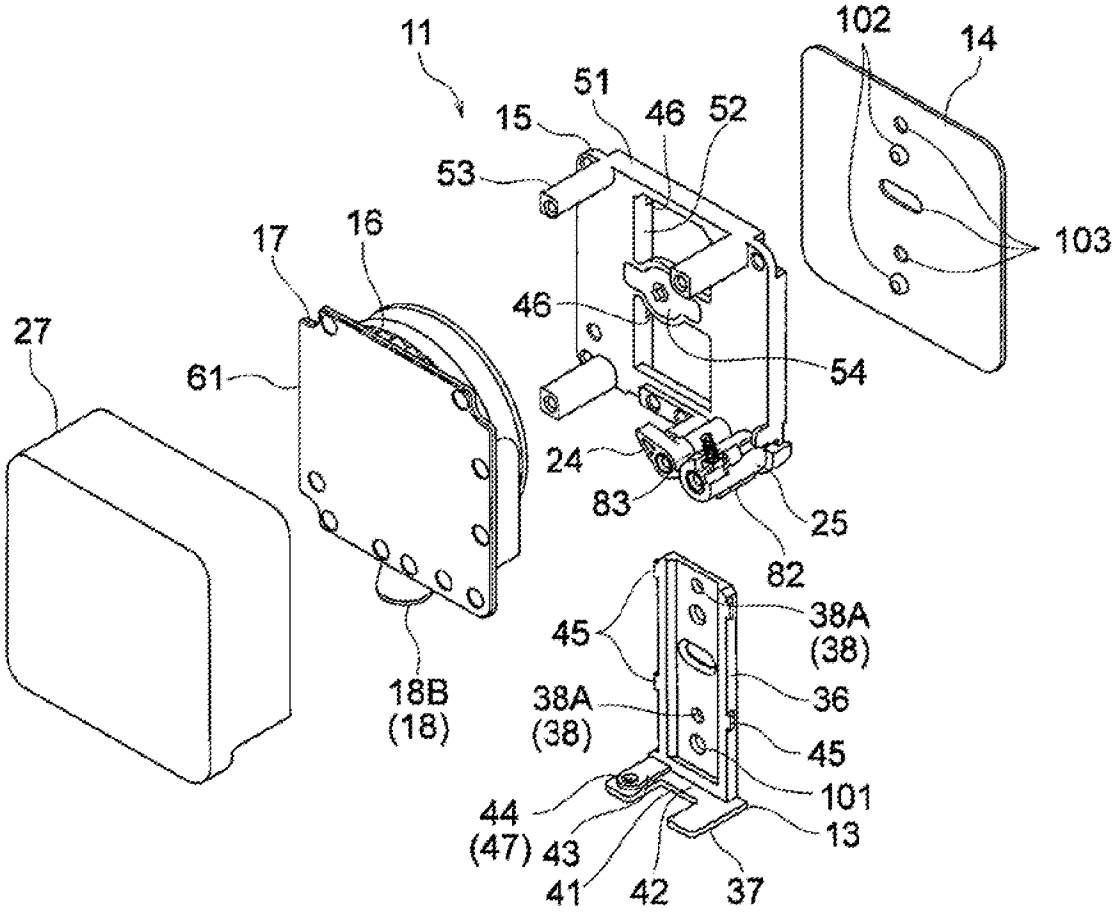
FIG. 3 is a perspective view of the clothing drying device shown in FIG. 2 partially disassembled as seen from the front.

As shown in FIG. 2 and FIG. 3, the cross section of the first frame 13 is formed in a shape of the letter "L", and the first frame 13 is slenderly elongated in the up-and-down direction. The first frame 13 has a first part 36 slenderly extending in the up-and-down direction and the second part 37 extending from the first part 36 in the direction intersecting with the first part 36. The first part 36 of the first frame 13 has a plurality of fixing portions 38 arranged side by side in the direction along the pull-out direction of the rope 18 (up-and-down direction, vertical direction). The plurality of fixing portions 38 are used for fixing the clothing drying device 11 to the wall surface 12. Each of the fixing portions 38 has a through hole 33A formed on the first part 36 and a screw (a bolt) (not shown in the figures) passed through the through hole 38A. Two of the through holes 38A have a circular shape, and the other one of the through holes 33A is formed in a shape of a slenderly elongated hole extending in the lateral direction. Therefore, even if the fastening position of the screw to the wall surface 12 is slightly deviated, the user can finely adjust the inclination of the first frame 13 with the position corresponding to the slenderly elongated hole-shaped through hole 33A.

The second portion can come into contact with the second frame 15 at the position where a first engaging portion 45 and a second engaging portion 46 are engaged. The second part 37 has: a notch portion 41 notched in a square shape; a spacer portion 42 provided adjacent to the notch portion 41 and interposed between the guide member 23 and the wall surface 12; a convex portion 43 provided around the notch portion 41; and a screw hole 44 provided on the convex portion 43 and having a female screw formed therein. The base portion 87 of the guide member 23, which will be described later, is fitted inside the notch portion 41. The spacer portion 42 defines a part around the hole portion 94 to secure a space between the hole portion 94 and the wall surface 12.

The convex portion 43 is fitted into a concave portion 88 provided around the base portion 87 of the guide member 23, thereby, the positions of the structures such as the second frame 15, the third frame 17, and the guide member 23 with respect to the first frame 13 can be determined. The second part 37 has a second fixing portion 47 fixing the second frame 15 and the second part 37. The second fixing portion 47 is composed of the screw hole 44, a female screw hole 91 of the guide member 23, and a screw (not shown) passed through the screw hole 44 and the female screw hole 91.

The first part 36 has a plurality of the first engaging portions 45 projecting toward the second frame 15 on the side surface in order to engage with the second frame 15. Each of the first engaging portions 45 is formed in a claw shape projecting outward toward the second frame 15. Each of the first engaging portions 45 has, for example, a trapezoidal cross-sectional shape, and has a first contact surface contacting the second engaging portion 46 at the position corresponding to the slope of the trapezoid. The first contact surface is formed obliquely with respect to the wall surface 12 so as to be away from the wall surface 12 as going toward the outside.

The second frame 15 is configured to be engageable with the first frame 13. As shown in FIG. 2 to FIG. 5, the second frame 15 has a substantially flat plate shape. The second frame 15 has: a flat plate-shaped second frame main body 51; a storage portion 52 provided on the central portion of the second frame main body 51 so as to be recessed from the wall surface 12 side; three columns 53 provided at the corners of the second frame body 51; a connecting portion 54 provided on the second frame main body 51 so as to define the bottom portion of the storage portion 52; a first rotating shaft 55 rotatably supporting the stopper portion 24; and a second rotating shaft 56 rotatably supporting the disengaging portion 25.

The storage portion 52 is formed so as to be recessed in a substantially quadrangular shape, in accordance with the shape of the first part 36 of the first frame 13. The storage portion 52 can store the first part 36 of the first frame 13. A part of the part defining the bottom portion of the storage portion 52 is composed of through holes.

The connecting portion 54 is provided so as to connect the parts sandwiching the storage portion 52 of the second frame 15. The connecting portion 54 defines a part of the bottom portion of the storage portion 52. The connecting portion 54 has a recessed portion capable of holding a support piece 75 of the brake portion 22 so as not to rotate. The recessed portion is recessed in a shape complementary to the support piece 75. The connecting portion 54 fixes the brake portion 22 via the support piece 75 to prevent the brake portion 22 from rotating together with the rotating drum 16.

The storage portion 52 has the plurality of second engaging portions 46 engaging with the plurality of first engaging portions 45 of the first frame 13 on its inner peripheral surface. The plurality of second engaging portions 46 are provided so as to come into contact with the plurality of first engaging portions 45 at the fitting position where the first part 36 is tightly fitted into the storage portion 52. Therefore, the plurality of second engaging portions 46 engage with the plurality of first engaging portions 45 at the fitting position.

Each of the plurality of second engaging portions 46 is formed in a claw shape projecting inward toward the first frame 13. The second engaging portion 46 has a shape complementary to the shape of the first engaging portion 45. That is, the second engaging portion 46 has, for example, a trapezoidal cross-sectional shape, and has a second contact surface coming into contact with the first engaging portion 45 at the position corresponding to the slope of the trapezoid. The second contact surface is formed obliquely with respect to the wall surface 12 so as to be away from the wall surface 12 as going toward the outside. The second engaging portion 46 is provided at the position closer to the wall surface 12 than the first engaging portion 45. Therefore, when the first frame 13 is in the fitting position, the second frame 15 is prevented from falling off from the first frame 13 in the direction of intersecting with the wall surface 12. The second engaging portion 46 can engage and disengage with the first engaging portion 45 relatively moving in the direction along the wall surface 12, and cannot engage and disengage with the first engaging portion 45 relatively moving in the direction intersecting with the wall surface 12.

As shown in FIG. 2 to FIG. 5, the third frame 17 is provided so as to face the first frame 13 and the second frame 15. The third frame 17 is fixed to the second frame 15 so as to store the drum 16 between the third frame 17 and the second frame 15. The third frame 17 has a flat plate-shaped third frame main body 61 and a columnar support shaft 62 provided at the center portion of the third frame main body 61. The support shaft 62 has a slit 63 so as to divide the diameter portion thereof. The inner peripheral portion of the spiral spring 21 is wound around the slit 63 and the support shaft 62 and fixed. Further, the drum 16 is rotatably supported by the support shaft 62. The spiral spring 21 is stored in a first concave portion 71, which will be described later, of the drum 16. The third frame 17 is fixed to the columns 53 of the second frame 15 with screwing or the like. The drum 16 is held between the third frame 17 and the second frame 15 in a state where the third frame 17 is fixed to the second frame 15.

The first frame 13, the second frame 15, and the third frame 17 are all preferably formed of metal materials, and more preferably formed of, for example, a zinc alloy die-cast or an aluminum alloy die-cast.

Figure 4:
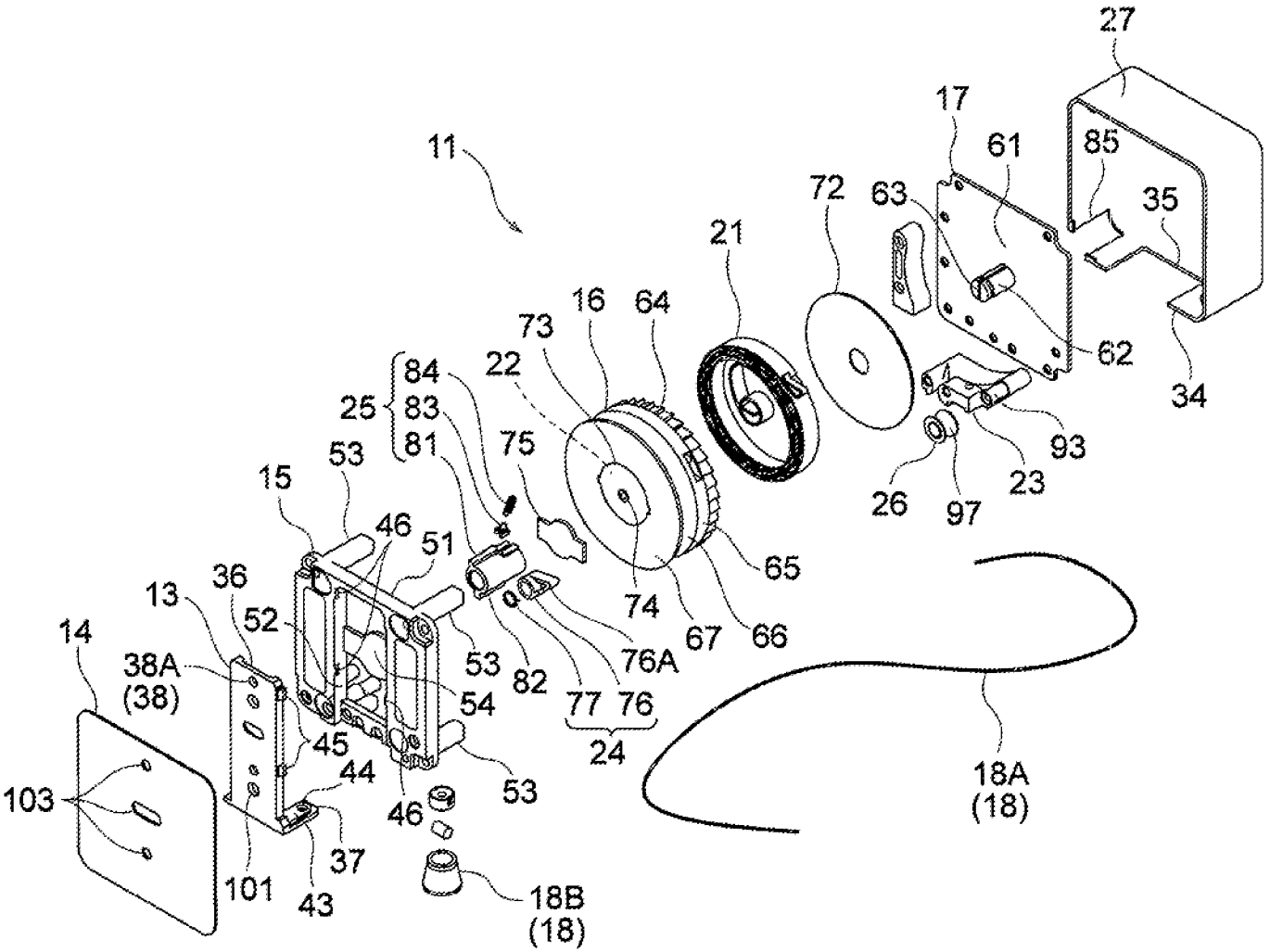
FIG. 4 is a perspective view of the clothing drying device shown in FIG. 1 disassembled as seen from the rear.
Figure 5:
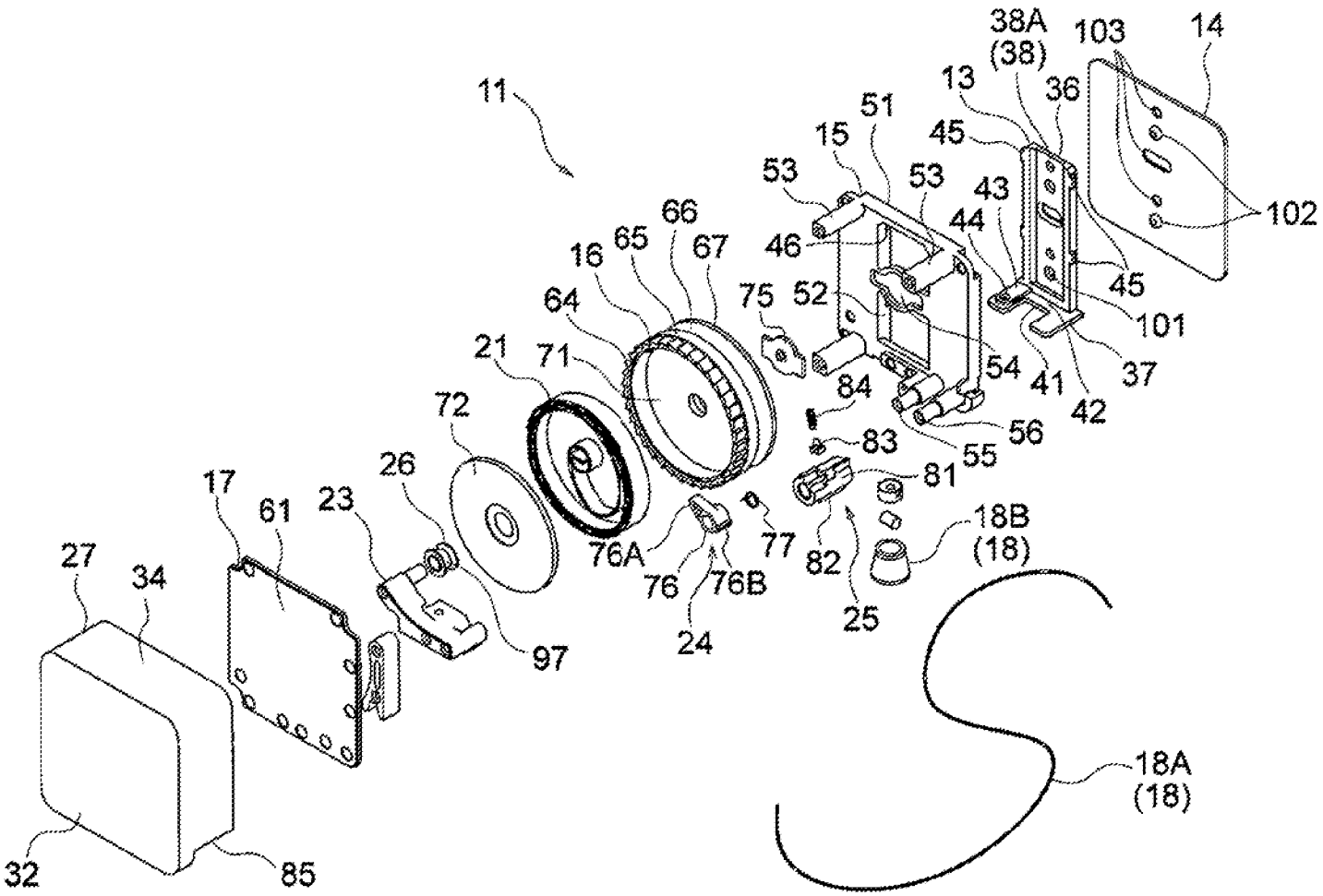
FIG. 5 is a perspective view of the clothing drying device shown in FIG. 1 disassembled as seen from the front.

As shown in FIG. 4 and FIG. 5 and the like, the drum 16 is formed in a cylindrical shape by, for example, resin materials. The drum 16 has: the gear portion 64 with a ratchet-shaped gear formed on the outer peripheral portion thereof; a columnar shaft portion 65 provided adjacent to the gear portion 64; a rope storage portion 66 having a diameter smaller than that of the shaft portion 65; a flange portion 67 expanding outward from the rope storage portion 66; the first concave portion 71 provided inside the gear portion 64 and the shaft portion 65; a lid body 72 covering the first concave portion 71; and a second concave portion 73 provided inside the rope storage portion 66. The rope storage portion 66 has a hook (not shown) to which the end portion of the rope 18 is fixed. The rope 18 is wound around the rope storage portion 66 in one direction (clockwise or counterclockwise direction). The flange portion 67 and the shaft portion 65 can hold the rope 18 from both sides in the extending direction of the support shaft 62 so that the rope 18 does not fail off from the rope storage portion 66.

The spiral spring 21 is stored inside the first concave portion 71, and is sealed by the lid body 72. The inner peripheral portion of the spiral spring 21 is fixed to the support shaft 62. The outer peripheral portion of the spiral spring 21 is fixed to the drum 16. The spiral spring 21 can give torque toward one direction to the drum 16 in a state of being stored in the first concave portion 71. That is, the spiral spring 21 can generate torque in the direction in which the rope 18 is wound around the drum 16.

The brake portion 22 is incorporated inside the second concave portion 73. The brake portion 22 is composed of a general oil damper. The brake portion 22 has a disc-shaped brake portion main body 74, and the support piece 75 including a protrusion fixedly supporting the brake portion main body 74. In the brake portion 22, for example, the gear of the brake portion main body 74 engages with the gear formed on the inner peripheral surface of the second concave portion 73. At that time, the brake portion main body 74 is supported by the support piece 75 (the projection) so as not to rotate together with the drum 16. Therefore, the brake portion 22 can generate a predetermined resistance force when the drum 16 rotates.

As shown in FIG. 2 to FIG. 5, the stopper portion 24 has: a stopper portion main body 76 having a claw-shaped tip portion 76A and a small piece 76B on the opposite side of the tip portion 76A; and a torsion coil spring 77 energizing the tip portion 76A of the stopper portion main body 76 in the direction of contacting the gear portion 64 of the drum 16. The stopper main body 76 is configured to be rotatable relative to the first rotating shaft 55. The torsion coil spring 77 is fitted on the first rotating shaft 55 so as to surround around the first rotating shaft 55.

The disengaging portion 25 has: a cylindrical disengaging portion main body 81; a lever 82 provided integrally with the disengaging portion main body 81; a pivot portion 83 rotatably provided on the outer peripheral surface of the disengaging portion main body 81; and a spring 84 provided on the pivot portion 83. The lever 82 is exposed to the outside through an opening 85 provided on the casing body 27, and the user hooks his finger on the lever 82. The pivot portion 83 can come into contact with the small piece 76B of the stopper portion via the spring 84.

Figure 6:
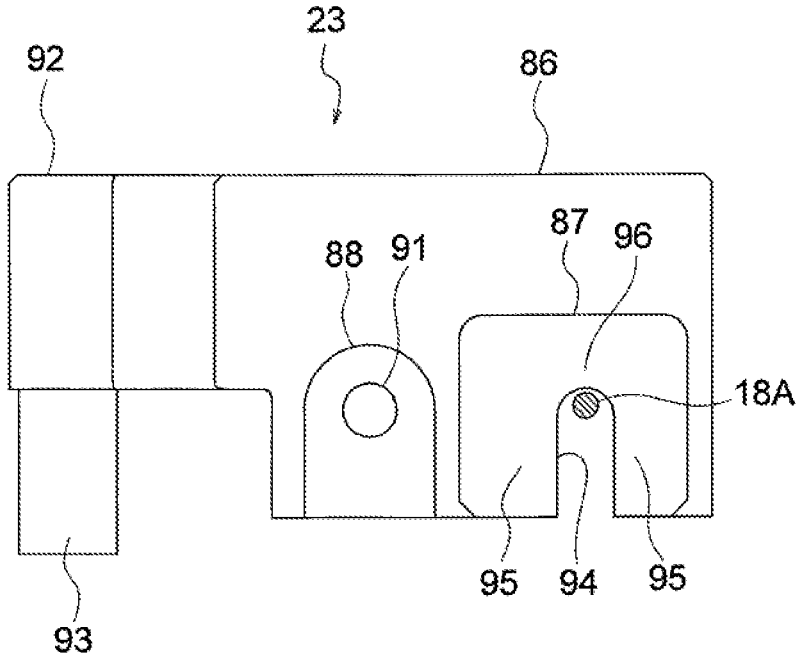
FIG. 6 is a bottom view of the guide member of the clothing drying device shown in FIG. 4.
Figure 7:
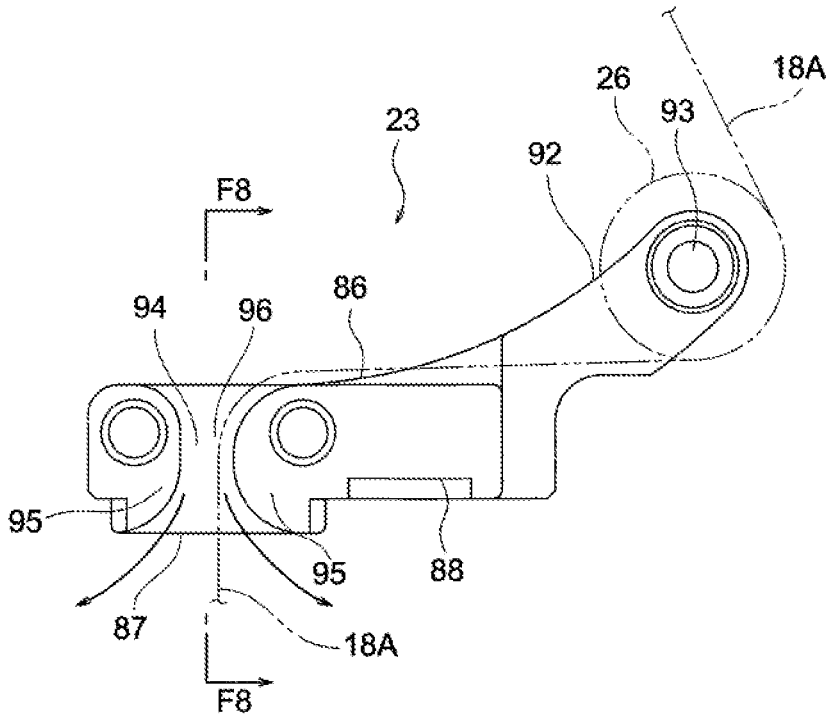
FIG. 7 is a rear view of the guide member shown in FIG. 6.

The guide member 23 is provided on the entrance/exit surface 34. As shown in FIG. 6 and FIG. 7, the guide member 23 has: a guide member main body 86; the gate-shaped base portion 37 provided on the guide member main body 86; the concave portion 88 provided on the vicinity of the base portion 87 on the guide member main body 86; the female screw hole 51 provided on the concave portion 88 and having a female screw formed therein; and an arm portion 92 extending laterally from the guide member main body 86 like an arm. The base portion 37 is formed so as to more protrude than the peripheral part of the guide member main body 86 and can be fitted inside the notch portion 41 of the second part 37 of the first frame 13. The concave portion 88 is formed so as to be more recessed than the peripheral part of the guide member main body 86. The guide member 23 is preferably formed integrally of metal materials, and more preferably formed of, for example, a zinc alloy die-cast or an aluminum alloy die-cast. In the present embodiment, the guide member 23 is integrally formed with the arm portion 92, but not limited to this embodiment. The guide member 23 may be provided separately from the arm portion 52.

The arm portion 92 has a pivoting shaft 93 extending along the direction of the support shaft 62 of the third frame 17. The pivoting shaft 93 can rotatably support the small pulley 26.

The base portion 87 of the guide member 23 is formed in a gate shape. The base portion 87 has: the hole portion 94 provided thereinside and the rope 18 is passed through; a pair of pole portions 95 extending in the direction intersecting with the wall surface 12; and a beam portion 96 passed between the pair of pole portions 95 at the end portion opposite to the end portion on the wall surface 12 side of the pair of pole portions 95. The outer edge of the hole portion 94 is defined by the pair of pole portions 95, the beam portion 96, and the spacer portion 42 (the notch portion 41) of the second part 37 of the first frame 13.

As shown in FIG. 6 and FIG. 7, each of the pair of pole portions 95 has an arc surface (arc cross section) becoming convex toward the hole portion 94. This arc surface (arc cross section) may be any arc. The cross section of the arc surface of the pole portion 95 may be, for example, semicircular, elliptical, or parabolic becoming convex towards the hole portion 94. When the cross section of the arc surface of the pole portion 95 is semicircular, the radius of curvature of the pole portion 55 is, for example, preferably 3 mm or more, and more preferably 4 mm or more.

The cross section of the pole portion 95 may have a shape without an extremely protruding corner so that the load is not concentrated on one place in the rope 18 hung on the pole portion 95, and may be, for example, a polygonal cross section of hexagon or more (such as hexagon, octagon, decagon, dodecagon, etc.).

Figure 8:
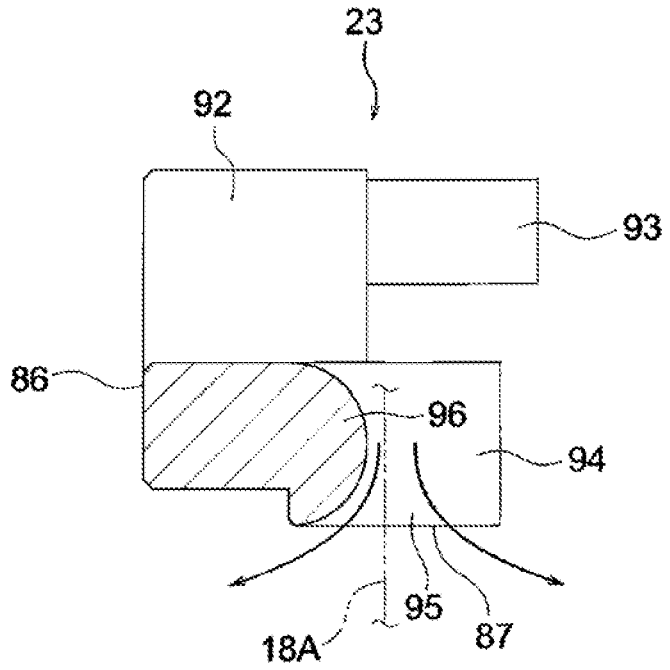
FIG. 8 is a cross-sectional view according to the position of F8-F8 line of the guide member shown in FIG. 7.

As shown in FIG. 6, the beam portion 96 has an arch shape becoming convex in the direction away from the wall surface 12. As shown in FIG. 8, the beam portion 96 has an arc surface (arc cross section) becoming convex toward the hole portion 94. This arc surface (arc cross section) may be any arc. The cross section of the arc surface of the beam portion 96 may be, for example, semicircular, elliptical, or parabolic becoming convex towards the hole portion 94. When the cross section of the arc surface of the beam portion 96 is semicircular, the radius of curvature of the beam portion 96 is, for example, preferably 3 mm or more, and more preferably 4 mm or more The cross section of the beam portion 96 may have a shape without an extremely protruding corner so that the load is not concentrated on one place in the rope 18 hung on the beam portion 95, and may be, for example, a polygonal cross section of hexagon or more (such as hexagon, octagon, decagon, dodecagon, etc.).

As shown in FIG. 2 and FIG. 4, the small pulley 26 has a tapered surface 97 around which the rope 18 is wound. The small pulley 26 guides the rope 18 which is wound around the drum 16 by the action of the spiral spring 21 to a predetermined position of the rope storage portion 66 of the drum 16 via the tapered surface 97. The small pulley 26 can impart a predetermined rotational resistance to the rope 18 to prevent the rope 18 from returning vigorously. The radius of curvature of the part with the smallest radius on the tapered surface 97 is preferably 3 mm or more, and more preferably 4 mm or more.

As shown in FIG. 2 to FIG. 5, the packing 14 is formed in a sheet shape by an elastic bodies. The packing 14 is preferably formed of a rubber material or other synthetic resin materials. The packing 14 has: a plurality of protrusion portions 102 that are fitted into a second through hole 101 (which does not constitute the fixing portion 38) of the first frame 13; and a plurality of perforated portions 103 through which the screws of the fixing portion 38 of the first frame 13 are passed. One of the perforated portions 103 is formed in a shape of a slenderly elongated hole extending in the lateral direction, corresponding to the through hole 38A of the first frame 13.

Figure 10:
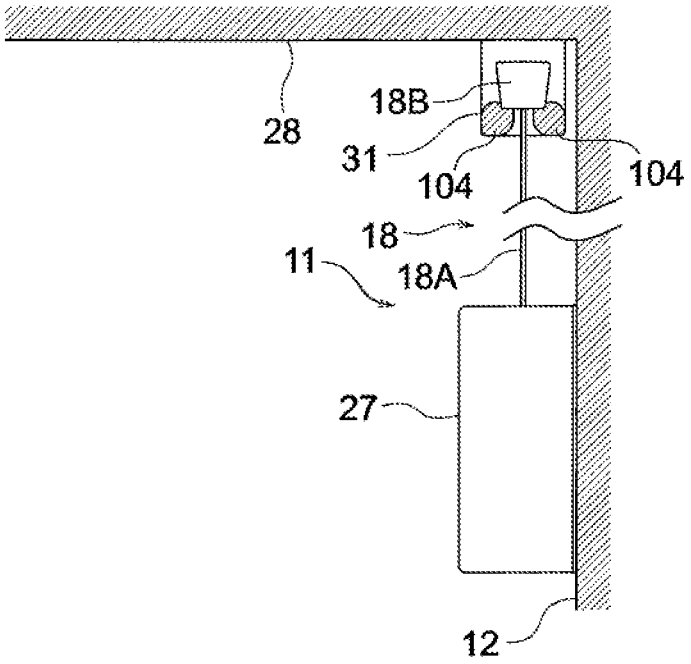
FIG. 10 is a top view showing another example of the positional relationship between the casing body of the clothing drying device shown in FIG. 1 and a receiving portion.

As shown in FIG. 9 and FIG. 10, the receiving portion 31 has a pair of hook portions 104. The grip portion 18B of the rope 13 can be held by being hooked on the pair of hook portions 104. As a result, the rope 18 can be stretched between the wall surface 12 to which the clothing drying device 11 is fixed and a wall surface (a second wall surface 12) to which the receiving portion 31 is fixed.

With reference to FIG. 2 and FIG. 3, a method for installing the clothing drying device 11 of the present embodiment on the wall surface 12 will be described. In FIG. 2 and FIG. 3, for the sake of explanation, the casing body 27, the first, frame 13, the second frame 15, and the third frame 17, etc. are shown in an exploded manner, but practically the casing body 27, the second frame 15, and the third frame 17 are pre-assembled as an integrated structure.

The user fixes the first frame 13 together with the packing 14 by the fixing portion 38 (the through holes 38A, the screws) to the wall surface 12 that the clothing drying device 11 is to be installed on. At this time, the packing 14 is installed so as to be sandwiched between the wall surface 12 and the first frame 13. The user attaches a structure, in which the casing body 27, the second frame 15 and the third frame 17 are integrated, to the first frame 13 fixed to the wall surface 12 in this way. More specifically, the integrated structure is inserted into the first frame 13 from above so that the first portion 36 of the first frame 13 is stored in the storage portion 52 of the second frame 15. As a result, the second frame 15 slides with respect to the first frame 13, and the lower surface of the second frame 15 and the guide member 23 come into contact with the second portion 37 of the first frame 13. Further, the convex portion 43 of the first frame 13 is inserted into the concave portion 88 of the guide member 23. As a result, the position of the integrated structure with respect to the first frame 13 is determined.

At that time, the second engaging portion 46 (the second contact surface) of the second frame 15 engages with the first engaging portion 45 (the first contact surface) of the first frame 13. In this state, with respect to the first frame 13, the integrated structure can be moved upward in the direction along the wall surface 12, but cannot be moved in the direction intersecting with the wall surface 12. In this state, the user fastens a screw to the screw hole 44 of the second portion 37 of the first frame 13 and the female screw hole 91 of the guide member main body 86 to fix the integrated structure to the first frame 13. As a result, the installation of the clothing drying device 11 on the wall surface 12 is completed easily and in a short time. The user can fix the receiving portion 31, on which the grip portion 18B of the rope 18 is hooked, to the second wall surface 12 different from the wall surface 12.

Subsequently, with reference to FIG. 9 and FIG. 10 and the like, the action of the clothing drying device 11 of the present embodiment will be described.

In the usage embodiment of FIG. 9, the receiving portion 31 is fixed to the second wall surface 12 which is different from the wall surface 12 in the room and faces the first wall surface 12. The user can pull out the rope 18 from the clothing drying device 11 and hook the grip portion 18B of the rope 13 on the pair of hook portions 104 of the receiving portion 31. In this way, the rope 18 is stretched indoors. In this state, the user can hang laundry or the like on the rope 18.

At this time, the plurality of fixing portions 38 of the first frame 13 are arranged in the up-and-down direction along the pull-out direction of the rope 16. Therefore, even when the user vigorously pulls out the rope 13 from the drum 16 toward the direction away from the wall surface 12, the moment of force acting at each of the fixing portions 38 can be minimized. As a result, the load applied to the fixing portion 38 can be reduced.

As the base portion 37 is formed in a gate shape and has the pair of pole portions 95 having an arc surface and the beam portion 96 having an arc surface, when pulling out the rope 13 from the drum 16, regardless of the direction in which the rope 18 is pulled out, such as the front direction (the direction indicated by the two arrows in FIG. 8 and the direction between them) and the lateral direction (the direction indicated by the two arrows along the arc surface in FIG. 7 and the direction between them), a large tension is not applied to one part of the rope 13 in the vicinity of the base portion 87. Therefore, the trouble that the rope 18 is cut do not occur. As the rope 18 is not pulled in the direction approaching the wall surface 12, there is no arc surface at the edge (the notch portion 41) of the hole portion 94 on the wall surface 12 side.

In the present embodiment, the support shaft 62 supporting the drum 16 is provided on the third frame 17, and the fixing portion 38 for fixing the clothing drying device 11 to the wall surface 12 is provided on the first frame 13 facing the third frame 17. Further, the second frame 15 integrated with the third frame 17 is slidably fixed to the first frame 13. Therefore, the support shaft 62 and the fixed portion 38 are not installed on the same frame, and the drum 16 supported by the support shaft 62 and the fixed portion 38 do not interfere with each other. Therefore, the fixing portion 38 can be installed at the position overlapping with the drum 16, and the casing body 27 can be made more compact than the conventional technique where the fixing portion 38 are arranged on the outside of the drum 16.

In the present embodiment, although the small pulley 26 is provided, the small pulley 26 is provided in parallel with the drum 16 and is contained within the thickness range of the drum 16. Therefore, even if the small pulley 26 is provided, the thickness dimension of the casing body 27 does not increase.

In the clothing drying device 11 of the present embodiment, when the rope 18 is stored in the casing body 27, the user rotates the lever 82 with his finger. As a result, the disengaging portion 25 rotates, and the pivot portion 83 and the spring 84 come into contact with the small piece 76B of the stopper portion 24. As a result, the stopper portion 24 rotates to disengage the engagement of the tip portion 76A of the stopper portion 24 with the gear portion 64 of the drum 16. As a result, the drum 16 is rotated by the drive of the spiral spring 21, and the rope 18 is wound around the rope storage portion 66. At this time, the speed at which the rope 18 is wound is reduced by the braking force of the brake portion 22 and the rotational resistance of the small pulley 26. As a result, when the rope 18 is collected, the grip portion 18B located at the tip of the rope 18 is prevented from being violently moved.

According to the present embodiment, the following can be said. The clothing drying device 11 has: the drum 16 with the rope 18 wound around; the casing body 27 having the entrance/exit surface 34 and storing the drum 16, the entrance/exit surface 34 is provided adjacent to the wall surface 12 the casing body 27 is fixed to and allows the rope 18 to go in and out; and the gate-shaped guide member 23 provided on the entrance/exit surface 34 comprising the hole portion 94 provided inside the guide member 23 and the rope 18 is passed through, a pair of pole portions 95 extending in the direction intersecting with the wall surface 12 and having an arc surface becoming convex toward the hole portion 94, and a beam portion 96 passed between the pair of pole portions 95 at the end portion opposite to the end portion of the wall surface 12 side of the pair of pole portions 95 and having an arc surface becoming convex toward the hole portion 94.

According to this configuration, as the arc surface is provided on both the pole portions 95 and the beam portion 96 of the guide member 23, when the rope 13 is pulled out of the casing body 27, it is possible to prevent a large tension from being applied to one place of the rope 18 in the vicinity of the guide member 23. As a result, the trouble that the rope 18 is cut at the position in the vicinity of the guide member 23 can be prevented. Further, as the rope 18 enters and exits on the entrance/exit surface 34 which is a surface adjacent to the wall surface 12, the configuration of a large-diameter pulley is omitted as compared with the conventional example where the rope 18 is pulled out from the front surface of the casing body 27. As a result, it is possible to prevent the thickness dimension of the casing body 27 from increasing and realize a compact clothing drying device 11.

In this case, the beam portion 96 has an arch shape becoming convex in the direction away from the wall surface 12. According to this configuration, the rope 18 is not caught at the boundary between the pole portions 95 and the beam portion 96, and this prevents a large tension from being applied to one place of the rope 18 at this position. Therefore, it is possible to more reliably prevent the trouble that the rope 18 is cut at the position in the vicinity of the guide member 23.

In this case, the clothing drying device 11 has the spacer portion 42 interposed between the guide member 23 and the wall surface 12 and defining a part around the hole portion 54 to secure a space between the hole portion 94 and the wall surface 12. According to this configuration, the guide member 23 from which the rope 18 is pulled out and the hole portion 94 thereinside can be arranged at a certain distance from the wall surface 12. As a result, the rope 18 can be arranged at the position where the user can easily grasp, and the user-friendly clothing drying device 11 can be realized.

In this case, the clothing drying device 11 includes the receiving portion 31 fixed to a wall surface different from the wall surface 12, and the rope 18 has the grip portion 18B provide on the end portion opposite to the drum 16 and capable of being hooked on the receiving portion 31. According to this configuration, the rope 18 can be easily hooked on the receiving portion 31 via the grip portion 13B, so that the user-friendly clothing drying device 11 can be realized.

The clothing drying device 11 has: the drum 16 with the rope 18 wound around; the first frame 13 having the plurality of fixing portions 38, the plurality of fixing portions is arranged side by side along the pull-out direction of the rope 18 and used for fixing the device 11 to the wall surface 12; the second frame 15 provided on both sides sandwiching the first frame 13 and capable of engaging with the first frame 13; and the third frame 17 fixed to the second frame 15 so as to store the drum 16 between the third frame 17 and the second frame 15 and having the supporting shaft 62 rotatably supporting the drum 16.

According to this configuration, the first frame 13 having the plurality of fixing portions 38 and the third frame 17 having the support shaft 62 are separately configured, and the second frame 15 is capable of engaging with the first frame 13, so that the plurality of fixing portions 38 can be arranged within the range of the installation height of the drum 16. As a result, the height dimension of the casing body 27 can be reduced to make the casing body 27 compact. Further, the plurality of fixing portions 38 and the support shaft 62 are arranged so as not to interfere with each other by the frames divided into multiple, so that the thickness dimension of the casing body 27 can be reduced to make the casing body 27 more compact.

In this case, the first frame 13 has the first engaging portion 45 protruding toward the second frame 15, and the second frame 15 has: the storage portion 52 capable of storing the first frame 13; and the second engaging portion 46 capable of engaging with the first engaging portion 45, capable of engaging and disengaging with the first engaging portion 45 moving relative to the direction along the wall surface 12, and incapable of engaging and disengaging with the first engaging portion 45 moving relative to the direction of intersecting with the wall surface 12.

According to this configuration, the attachment/detachment direction of the second frame 15 with respect to the first frame 13 can be set only in the direction along the wall surface 12. As a result, even when the user pulls the rope 18 in the direction away from the wall surface 12, it is possible to prevent the trouble that the second frame 15 falls off from the first frame 13.

In this case, the first frame 13 has: the first part 36 capable of being stored in the storage portion 52; and the second part 37 extending from the first part 36 in the direction intersecting with the first part 36 and coming into contact with the second frame 15 at the position where the first engaging portion 45 and the second engaging portion 46 are engaged. According to this configuration, when the second frame 15 is fitted to the first frame 13, the first frame 13 can be positioned by the second portion 37. As a result, when the first frame 13 and the second frame 15 are screwed and fixed in a later step, the screw can be easily fastened, and the user-friendly clothing drying device 11 can be realized.

In this case, the second part 37 has the second fixing portion 47 fixing the second frame 15 and the second part 37. According to this configuration, the second fixing portion 47 can prevent the second frame 15 from falling off in the direction along the wall surface 12.

In this case, the drum 16 incorporates the brake portion 22 acting as a resistance when the drum 16 rotates, and the second frame 15 has the connecting portion 54 connecting parts sandwiching the storage portion 52 and fixing the brake portion 22 to prevent the brake portion 22 from rotating together with the rotating drum 16.

According to this configuration, the brake portion 22 can prevent the rope 13 from vigorously returning to the inside of the casing body 27, and prevents the tip of the rope 13 from violently moving when the drum 16 is rewound.

In this case, the connecting portion 54 defines the bottom portion of the storage portion 52. According to this configuration, the connecting portion 54 can be provided with both a function of fixing the brake portion 22 and a function of holding the first frame 13 stored in the storage portion 52 in the storage portion 52. As a result, the number of components of the clothing drying device 11 can be reduced, and the clothing drying device 11 can be made compact.

In this case, the drum 16 has the ratchet-shaped gear portion 64, and the stopper portion 24 engaging with the gear portion 64, and the disengaging portion 25 disengaging the stopper portion 24 from the gear portion 64 are attached to either the second frame 15 or the third frame 17. According to this configuration, the function to prevent rewinding of the rope 18 can be realized by the ratchet type stopper.

In this case, the drum 16 has a concave portion provided inside the gear portion 64 and capable of incorporating a spring generating torque in the direction the rope 18 is wound around the drum 16. According to this configuration, the spring generating torque for collecting the rope 18 can be arranged on the concave portion inside the gear portion 64, and the space inside the clothing drying device 11 can be effectively utilized to make the clothing drying device 11 more compact.

The above-described embodiment can be implemented with various replacements and modifications. That is, in the present embodiment, the first rotating shaft 55 and the second rotating shaft 56 are provided on the second frame 15, and the stopper portion 24 and the disengaging portion 25 are provided on the second frame 15, but the arrangement of the stopper portion 24 and the disengaging portion 25 is not limited to this. Naturally, the first rotating shaft 55 and the second rotating shaft 56 may be provided on the third frame 17, and the stopper portion 24 and the disengaging portion 25 may be provided on the third frame 17.

REFERENCE SIGNS LIST

11 clothing drying device
12 wall surface

13 first frame
14 packing
15 second frame
16 drum
17 third frame
18 rope
18A rope main body
18B grip portion
21 spiral spring
22 brake portion
23 guide member
24 stopper portion
25 disengaging portion
26 small pulley
27 casing body
28 second wall surface
31 receiving portion
32 front surface
33 side surface
34 entrance/exit surface
35 opening portion
36 first part
37 second part
38 fixing portion
38A through hole
41 notch portion
42 spacer portion
43 convex portion
44 screw hole
45 first engaging portion
46 second engaging portion
47 second fixing portion
51 second frame main body
52 storage portion
53 column
54 connecting portion
55 first rotating shaft
56 second rotating shaft
61 third frame main body
62 support shaft
63 slit
64 gear portion
65 shaft portion
66 rope storage portion
67 flange portion
71 first concave portion
72 lid body
73 second concave portion
74 brake portion main body
75 support piece
76 stopper portion main body
76A tip portion
76B small piece
77 torsion coil spring
81 disengaging portion main body
82 lever
83 pivot portion
84 spring
85 opening
86 guide member main body
87 base portion
88 concave portion
91 female screw hole
92 arm portion
93 pivoting shaft
94 hole portion
95 pole portion
96 beam portion
97 tapered surface
101 second through hole
102 protrusion portion
103 perforated portion
104 hook portion

The invention claimed is:

1. A clothing drying device comprising:

a drum with a rope wound around;

a casing body comprises an entrance/exit surface and storing the drum, the entrance/exit surface being provided adjacent to a wall surface to which the casing body is fixed, the entrance/exit surface allowing the rope to go in and out;

a gate-shaped guide member provided on the entrance/exit surface, comprising a hole portion provided inside the guide member and the rope is passed through, a pair of pole portions extending in the direction intersecting with the wall surface and comprising an arc surface becoming convex toward the hole portion, and a beam portion passed between the pair of pole portions at the end portion opposite to the end portion of the wall surface side of the pair of pole portions and comprising an arc surface becoming convex toward the hole portion; and a spacer portion interposed between the guide member and the wall surface and defining a part around the hole portion to secure a space between the hole portion and the wall surface.

2. The clothing drying device according to claim 1, wherein the beam portion comprises an arch shape being convex in the direction away from the wall surface.

3. The clothing drying device according to claim 1, comprising a receiving portion fixed to a wall surface different from the wall surface, wherein the rope comprises a grip portion provided on the end portion opposite to the drum and capable of being hooked on the receiving portion.

4. A clothing drying device comprising:

a drum with a rope wound around;

a first frame comprising a plurality of fixing portions, the plurality of fixing portions being arranged along the pull-out direction of the rope and used for fixing the device to a wall surface, the first frame comprising a fixing surface to be fixed to the wall surface;

a second frame provided on both sides of the first frame with resect to a direction along the fixing surface so as to sandwich the first frame therebetween and capable of engaging with the first frame; and a third frame fixed to the second frame so as to store the drum between the third frame and the second frame and comprising a supporting shaft rotatably supporting the drum, wherein the first frame comprises a first engaging portion protruding toward the second frame, the second frame comprises a storage portion capable of storing the first frame and a second engaging portion capable of engaging with the first engaging portion, the second engaging portion being capable of engaging and disengaging with the first engaging portion moving relative to the direction along the wall surface and incapable of engaging and disengaging with the first engaging portion moving relative to the direction intersecting with the wall surface, and the first frame comprises a first part capable of being stored in the storage portion, and a second part extending from the first part in the direction intersecting with the first part and coming into contact with the second frame at the position the first engaging portion and the second engaging portion are engaged.

5. The clothing drying device according to claim 4, wherein the second part comprises a second fixing portion fixing the second frame and the second part.

6. The clothing drying device according to claim 5, wherein the drum incorporates a brake portion acting as a resistance when the drum rotates, and the second frame comprises a connecting portion connecting parts sandwiching the storage portion, and fixing the brake portion to prevent the brake portion from rotating together with the rotating drum.

7. The clothing drying device according to claim 6, wherein the connecting portion defines a bottom portion of the storage portion.

8. The clothing drying device according to claim 4, wherein the drum comprises a ratchet-shaped gear portion, and a stopper portion engaging with the gear portion, and a disengaging portion disengaging the stopper portion from the gear portion are attached to either the second frame or the third frame.

9. The clothing drying device according to claim 8, wherein the drum comprises a concave portion provided inside the gear portion and capable of incorporating a spring generating torque in the direction the rope is wound around the drum.

* * * * *